US007819646B2

(12) United States Patent
Hope et al.

(10) Patent No.: US 7,819,646 B2
(45) Date of Patent: Oct. 26, 2010

(54) ROTARY PISTON VACUUM PUMP WITH WASHING INSTALLATION

(75) Inventors: Mark Christopher Hope, Croydon (GB); Clive Marcus Lloyd Tunna, Bolney (GB); Frederick John Underwood, Storrington (GB)

(73) Assignee: Edwards Limited, Crawley, West Sussex (GB)

( * ) Notice: Subject to any disclaimer, the term of this patent is extended or adjusted under 35 U.S.C. 154(b) by 776 days.

(21) Appl. No.: 10/531,563

(22) PCT Filed: Oct. 6, 2003

(86) PCT No.: PCT/GB03/04330

§ 371 (c)(1),
(2), (4) Date: Nov. 16, 2005

(87) PCT Pub. No.: WO2004/036047

PCT Pub. Date: Apr. 29, 2004

(65) Prior Publication Data

US 2006/0120909 A1 Jun. 8, 2006

(30) Foreign Application Priority Data

Oct. 14, 2002 (GB) ..... 0223767.5
Sep. 23, 2003 (GB) ..... 0322238.7

(51) Int. Cl.
*F01C 1/16* (2006.01)
*F03C 2/00* (2006.01)
*F03C 4/00* (2006.01)

(52) U.S. Cl. ..... 418/201.1; 418/1; 418/15; 418/83; 418/97

(58) Field of Classification Search ..... 418/201.1, 418/9, 10, 15, 83, 85, 87, 97, 1
See application file for complete search history.

(56) References Cited

U.S. PATENT DOCUMENTS

| | | | | |
|---|---|---|---|---|
| 4,400,891 | A | | 8/1983 | Kongshaug |
| 4,984,974 | A | * | 1/1991 | Naya et al. ..... 418/87 |
| 5,046,934 | A | | 9/1991 | Berges |
| 5,287,834 | A | | 2/1994 | Flynn |
| 5,443,644 | A | | 8/1995 | Ozawa |
| 5,452,696 | A | | 9/1995 | Flynn |
| 5,753,049 | A | | 5/1998 | Ihara et al. |
| 5,924,855 | A | | 7/1999 | Dahmlos et al. |

(Continued)

FOREIGN PATENT DOCUMENTS

CH 225 028 A 12/1942

(Continued)

OTHER PUBLICATIONS

Benno Basler and Tadeusz Zaba, Abstract of CH660056 A, "Method and Device for Cleaning the Blades of a Gas Turbine During Operation," Mar. 13, 1987.

(Continued)

*Primary Examiner*—Theresa Trieu

(57) ABSTRACT

A pump having a rotor, a stator, a housing enclosing the rotor and the stator, the housing having an inlet for a fluid, and a port for receiving a fluid which acts on deposits on a surface of the rotor and on a surface of the stator positioned downstream from the inlet.

47 Claims, 8 Drawing Sheets

U.S. PATENT DOCUMENTS

| | | | |
|---|---|---|---|
| 6,224,326 | B1 | 5/2001 | Puech |
| 2002/0141882 | A1 | 10/2002 | Ingistov et al. |

FOREIGN PATENT DOCUMENTS

| | | | |
|---|---|---|---|
| DE | 198 20 622 | A1 | 11/1999 |
| EP | 0 320 956 | B1 | 3/1993 |
| EP | 0 879 964 | A1 | 11/1998 |

OTHER PUBLICATIONS

Rikuro Shirase, Abstract of JP1127308 A, "Injection Molding Machine withColorant-Feeding Device," May 19, 1989.

Dietmar Rook, Christian Dahmlos, Ralf Steffens, Abstract of DE19522554 A, "Compressor Operative Chamber Surface Cleaning Method," Jan. 2, 1997.

United Kingdom Search Report for Application No. GB 0223767.5, Date of search: Nov. 17, 2003.

Yuji Yamada, Patent Abstracts of Japan; Abstract of "Roots Fluid Machine," Kobe Steel Ltd; Publication No. 10299676, Publication Date Nov. 10, 1998.

Yoshiyuki Nishimura, Patent Abstracts of Japan; Abstract of "Running Method of Screw Compressor of Non-Replenishing and Spray Injection Type," Kobe Steel Ltd; Publication.

No. 60017283, Publication Date Jan. 29, 1985.

PCT International Search Report for International Application No. PCT/GB03/04330; Date of mailing Jan. 15, 2004.

* cited by examiner (Prior Art)

ROTARY PISTON VACUUM PUMP WITH WASHING INSTALLATION

FIELD OF THE INVENTION

This invention relates to the field of vacuum pumps. In particular, but not strictly limited to vacuum pumps with a screw type configuration.

BACKGROUND OF THE INVENTION

Screw pumps usually comprise two spaced parallel shafts each carrying externally threaded rotors, the shafts being mounted in a pump housing such that the threads of the rotors intermesh. Close tolerances between the rotor threads at the points of intermeshing and with the internal surface of the pump body, which typically acts as a stator, causes volumes of gas being pumped between an inlet and an outlet to be trapped between the threads of the rotors and the internal surface and thereby urged through the pump as the rotors rotate.

Screw pumps are widely regarded as a reliable means for generating vacuum conditions in a multitude of processes. Consequently, they are being applied to an increasing number of industrial processes. Such applications may involve materials that have "waxy" or "fatty" properties e.g. tallow based plasticisers. In operation of the pump, these products form deposits on the surfaces of the pump. On shutdown of the pump these surfaces cool, the deposits also cool and solidify within the pump. Where such deposits are located in clearance regions between components, they can cause the pump to seize up such that restart is inhibited or even prevented.

Similar problems can be encountered in a number of semiconductor processes that use vacuum pumps, especially those in the chemical vapour deposition (CVD) category 200 shown for example in FIG. 10. Such processes can produce a significant amount of by-product material 202. This can be in the form of powder or dust, which may remain loose or become compacted, or in the form of hard solids, especially if the process gas is condensable and sublimes on lower temperature surfaces. This material can be formed in the process chamber 201, in the foreline 204 between the chamber and the pump, and/or in the vacuum pump 203 itself. If such material accumulates on the internal surfaces of the pump during its operation, this can effectively fill the vacant running clearance between the rotor and stator elements on the pump, and can also cause spikes in the current demand on the motor of the vacuum pump. If this continues unabated, then this build-up of solid material can eventually cause the motor to become overloaded, and thus cause the control system to shut down the vacuum pump. Should the pump be allowed to cool down to ambient temperature, then this accumulated material will become compressed between the rotor and stator elements. Due to the relatively large surface area of potential contact that this creates between the rotor and stator elements, such compression of by-product material can increase the frictional forces opposing rotation by an order of magnitude.

In order to release the rotors in prior art pumps, a facility is provided whereby a bar can be inserted into sockets attached to the primary shaft of the rotor though an access panel. This bar is used as a lever to try to rotate the shaft and release the mechanism such that the machine can be restarted. This levering system allows more rotational force to be applied to the internal components than could be exerted by the motor. Such force will be transmitted to the rotor vanes and the associated stresses may prove to be detrimental to the structure of the rotor. If this system fails to release the mechanism it is then necessary to disassemble the apparatus such that a liquid solvent can be poured into the pump casing to dissolve the residue to a level where the shaft can be rotated manually. This disassembly not only causes the pump to be off line for a certain length of time, but it then must be re-commissioned and re-tested to ensure the reliability of the connections to the surrounding apparatus.

It is an aim of the present invention to overcome the aforementioned problems associated with pump technology.

BRIEF SUMMARY OF THE INVENTION

The present invention provides a pump comprising a rotor element and a stator element; a housing enclosing the elements and having an inlet for receiving pumped fluid, and downstream from the inlet, at least one port; and means for injecting, into the housing via said at least one port, fluid for acting on deposits located on the element surfaces to enable said deposits to be removed therefrom. As the port(s) are located downstream of the inlet, any fluid injected on the rotor and stator elements can be directly injected into the swept volume to impinge on the surfaces of these elements. This can significantly improve cleaning efficiency in comparison to a system where the cleaning fluid is introduced via the housing inlet for pumped fluids. Where many ports are provided, these may be located in an array. For example, the ports may be located radially about the housing, and/or may be located along the length of the rotor element.

The housing may comprise an inner layer and an outer layer between which a cavity may be formed. In operation of the pump a liquid may be passed through this cavity. The inner layer of the housing may act as the stator of the pump.

The port may include a nozzle through which, in use, fluid is sprayed, this nozzle may be integrally formed within the port.

The pump may be a screw pump 30*a* comprising two threaded rotors in which case the port(s) may be located after the first two complete turns of thread of the rotors from the inlet end of the rotor. Alternatively the pump may be a Northey ("claw") pump 30*b* or a Roots pump 30*c* as shown in FIG. 5 to include an arrangement for supplying fluid to a pump in accordance with the present invention.

The fluid may be a liquid or a vapour. The fluid may be a solvent for dissolving residue collected on the rotor when the pump is in use or it may be steam. The fluid may comprise a reactive substance for reacting with the deposits, and may comprise, for example, a halogen. Such fluid can be particularly useful as a cleaning fluid when the pump is used as part of a CVD process to remove solid by-products of the CVD process.

Thus, the present invention also provides a pump comprising a rotor element and a stator element; a housing enclosing the elements and having at least one port; and means for injecting, into the housing via said at least one port, a fluid comprising a reactive substance for reacting with particulates located on the element surfaces to enable said particulates to be removed therefrom.

The fluid may comprise a halogen, for example fluorine, and may be a fluorinated gas, such as a perfluorinated gas. Examples of such fluid include $ClF_3$, $F_2$, and $NF_3$.

The invention thus extends to chemical vapour deposition apparatus 32 comprising a process chamber 31 and a pump according to any preceding claim for evacuating the process chamber, wherein, in use, the deposits are a by-product of a chemical vapour deposition process.

According to the present invention there is further provided a method of managing deposits within a pump, the pump comprising a rotor element and a stator element, and a housing enclosing the elements and having an inlet for receiving pumped fluid, and downstream from the inlet, at least one port, the method comprising injecting, into the housing via said at least one port, fluid for acting on deposits located on the element surfaces to enable said deposits to be removed therefrom.

The present invention also provides a method for managing deposits within a pump, the pump comprising a rotor element and a stator element, and a housing enclosing the elements and having at least one port; the method comprising injecting, into the housing via said at least one port, a fluid comprising a reactive substance for reacting with particulates located on the element surfaces to enable said particulates to be removed therefrom.

Referring to FIG. 6, the delivery of fluid may occur at predetermined intervals during operation of the pump, for example, using solenoid valve control. Furthermore a monitoring step 100 may be performed wherein the performance of the pump is monitored, for example, by measuring at least one of the group of rotor speed, power consumption, and volumetric gas flow rate. These measured parameters may be used to determine the extent of accumulation of deposits on the internal working surfaces of the pump 101. A fluid flow rate may then be calculated, this rate being that of the delivered fluid that would be sufficient to compensate for the quantity of accumulated deposits 102 as determined above. Subsequently, the flow rate of fluid being delivered to the rotor may be adjusted 103 to reflect the new calculated value.

Referring to FIG. 7, according to the present invention there is further provided a method for managing deposits within a pump mechanism by introducing fluid suitable for dissolving, diluting or otherwise disengaging deposits which have accumulated on the internal working surfaces of the pump, the method comprising the steps of:

(a) monitoring the performance of the pump 110, for example, by recording at least one of the group of rotor speed, power consumption, and volumetric gas flow rate;

(b) calculating the rate of accumulation of deposits on the internal working surfaces of the pump based on the monitored performance 111;

(c) calculating a fluid flow rate required to compensate for the accumulation of deposits as determined in step (b) 112; and (d) effecting an adjustment of the flow rate of fluid being delivered to the rotor to reflect the calculated value from step (c) 113.

The pump may be inoperative as the fluid is delivered, for example where seizure has occurred or where cleaning needs to take place. Referring to FIG. 8, in this case, the method may further involve applying torque 114 to the rotors of the pump in order to overcome any remaining impeding force potentially caused by deposits located on the internal working components of the pump. Under certain conditions, for example where the material being transported is particularly viscous or waxy and this viscosity may reduce with an increase in temperature, the method may further involve the introduction of thermal fluid 115 into a cavity provided within the housing of the pump, where this cavity encircles the rotor components. This thermal fluid may be heated 116 in order to raise the temperature of the fluid and the deposits sufficiently to release the deposits prior to applying the torque as discussed above. (FIG. 9).

The controller of the dry pump apparatus may comprise a microprocessor which may be embodied in a computer, which in turn is optionally programmed by computer software which, when installed on the computer, causes it to perform the method steps (a) to (d) mentioned above. The carrier medium of this program may be selected from but is not strictly limited to a floppy disk, a CD, a mini-disc or digital tape.

BRIEF DESCRIPTION OF THE DRAWINGS

An example of the present invention will now be described with reference to the accompanying drawings in which.

DETAILED DESCRIPTION

Figure 1:
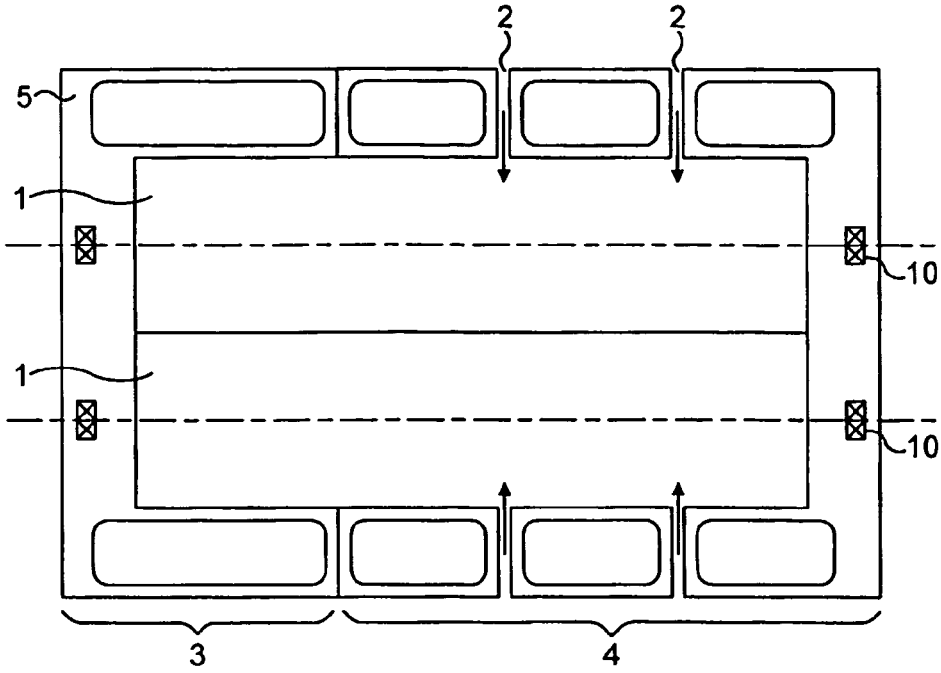
FIG. 1 illustrates a schematic of a screw pump of the present invention.
Figure 2:
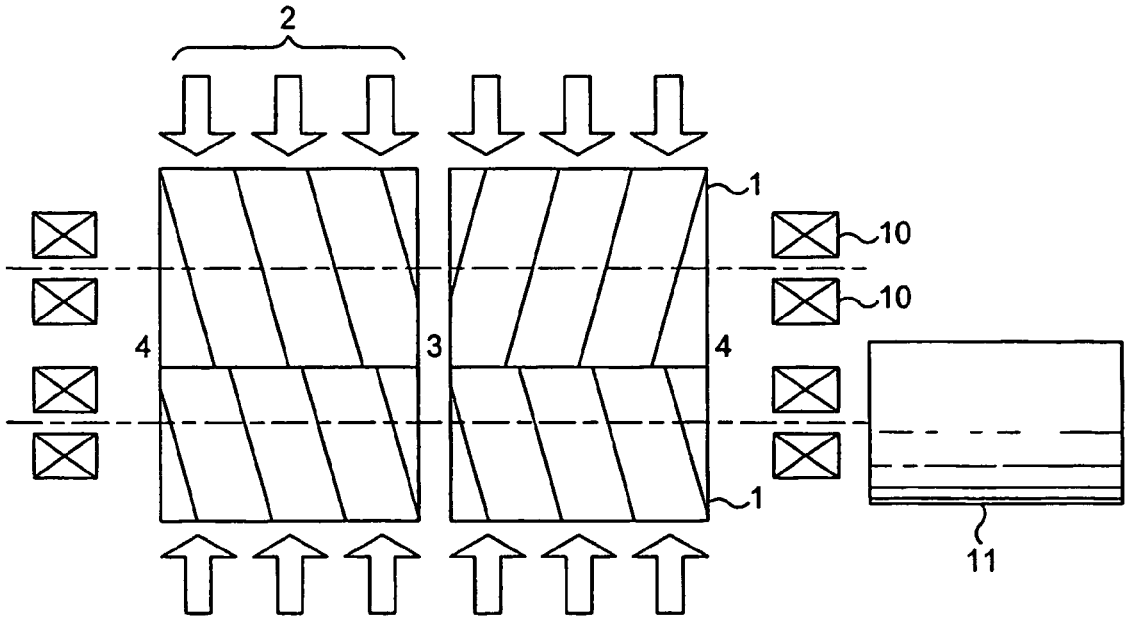
FIG. 2 illustrates a schematic of a double-ended screw pump of the present invention.

Whilst the example pumps illustrated in FIGS. 1 and 2 are screw pumps it is envisaged that this invention can be applied to any type of vacuum pump, in particular claw pumps.

Figure 3:
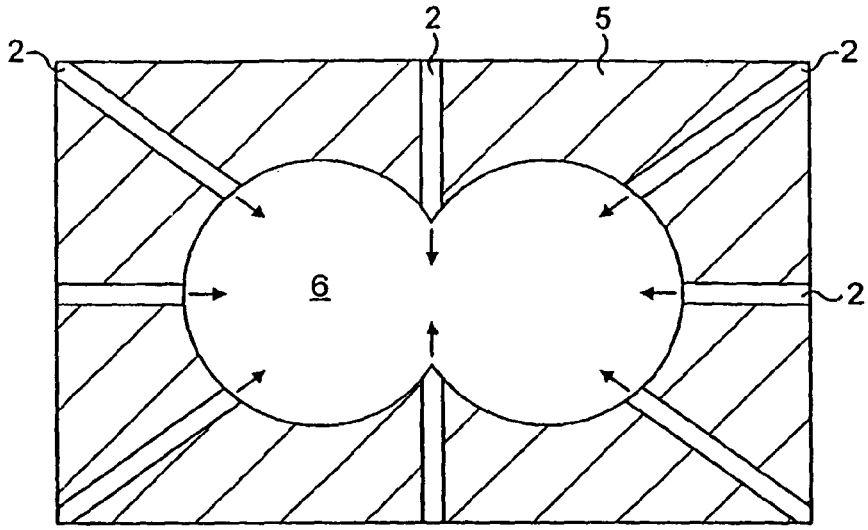
FIG. 3 is an end sectional view of the pump of FIGS. 1 and 2.
Figure 4:
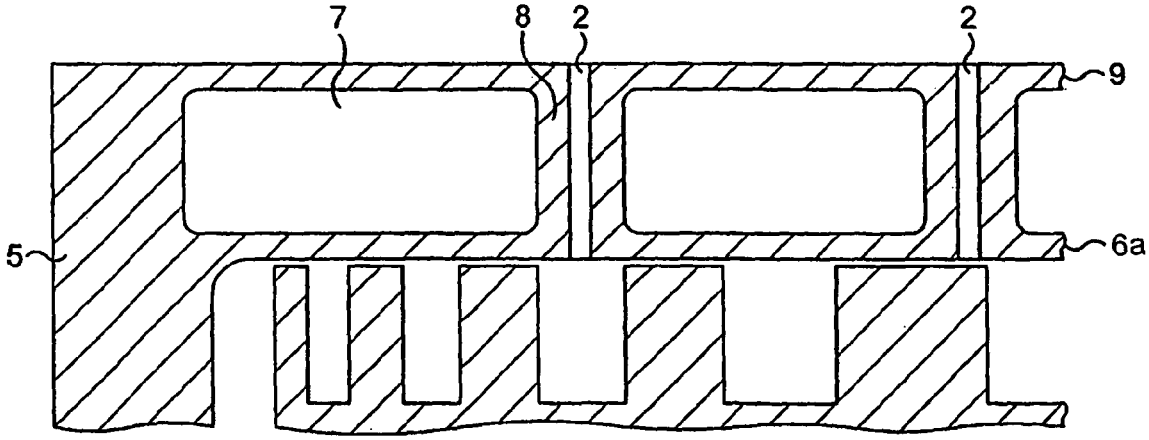
FIG. 4 is a detailed view of a section of a water jacket that illustrates the implementation of an injection port.

In the example of FIG. 1, two rotors 1 are provided within an outer housing/stator 5 where the outer housing serves as the stator of the pump. The two contra-rotating, intermeshing rotors 1 are positioned such that their central axes lie parallel to one another. The rotors are mounted through bearings 10 and driven by a motor 11 (shown in FIG. 2). Injection ports 2 are provided along the length of the rotor, in the examples of FIGS. 1 and 2 (shown as solid lines in FIG. 3) these ports 2 are located laterally within the pump on the opposite side of the rotors from the intermeshing region of the rotors. However, the ports may be positioned at any radial location around the outer housing/stator 5. Some of these locations are illustrated in FIG. 3.

The ports 2, which may contain nozzles 2*a* to allow the fluid to be sprayed, are preferably distributed along the length of the outer housing/stator 5 such that the solvent or steam can be easily applied over the entire rotor. Alternatively, this distribution of ports allows the fluid to be readily concentrated in any particular problem area that may arise. This is especially important when solvent is injected during operation, in order to limit the impact on pump performance. If, for example, a single port was to be used at the inlet 3 of the pump, this may have a detrimental effect on the capacity of by-products that could be transported away from the evacuated chamber (not shown) by the pump. By bringing solvent into contact with the rotor 1 after the first few turns of the thread, the likelihood of backward contamination of the solvent into the chamber will be reduced.

Furthermore, where solvent is introduced in the inlet region of the pump, the pressure is such at the inlet that there is an increased risk that the solvent will flash. In processes where it is necessary for the solvent to remain in liquid phase the solvent must be introduced closer towards the exhaust region of the pump where the pressures will have risen. As solvent is introduced through a number of ports 2 along the length of the outer housing/stator 5, the overall effect is to gradually increase the quantity of solvent present, as the likelihood of residue build up on the rotor 1 increases towards the exhaust stages. An additional benefit may be seen in some configurations where addition of liquid into the final turns of thread of the rotor will act to seal the clearances between the rotor and the stator in this region of the pump. Thus leakage of gas will be substantially reduced and performance of the pump will be improved.

In some processes, it is not appropriate to introduce solvent during operation as the waste products from the evacuated chamber are collected at the outlet of the pump for a particular purpose and this material ought not to be contaminated. Other applications may not result in levels of residue that warrant constant injection of solvent during operation. In these cases, and where an unplanned shut down of the pump occurs such that standard practices, such as purging, are not followed, the residue from the process cools down as the apparatus drops in temperature. In these circumstances a seizure of the mechanism may occur as deposits build up and become more viscous or solidify. In a system according to the present invention, the injection ports 2 can be used to introduce a solvent into the stator cavity 6 in a distributed manner without needing to go to the expense or inconvenience of disassembling the apparatus. Once the solvent has acted upon the deposits to either soften or dissolve them, the shaft may then be rotated either by using the motor or manually to release the components without applying excessive, potentially damaging, force to the rotor.

Figure 5:
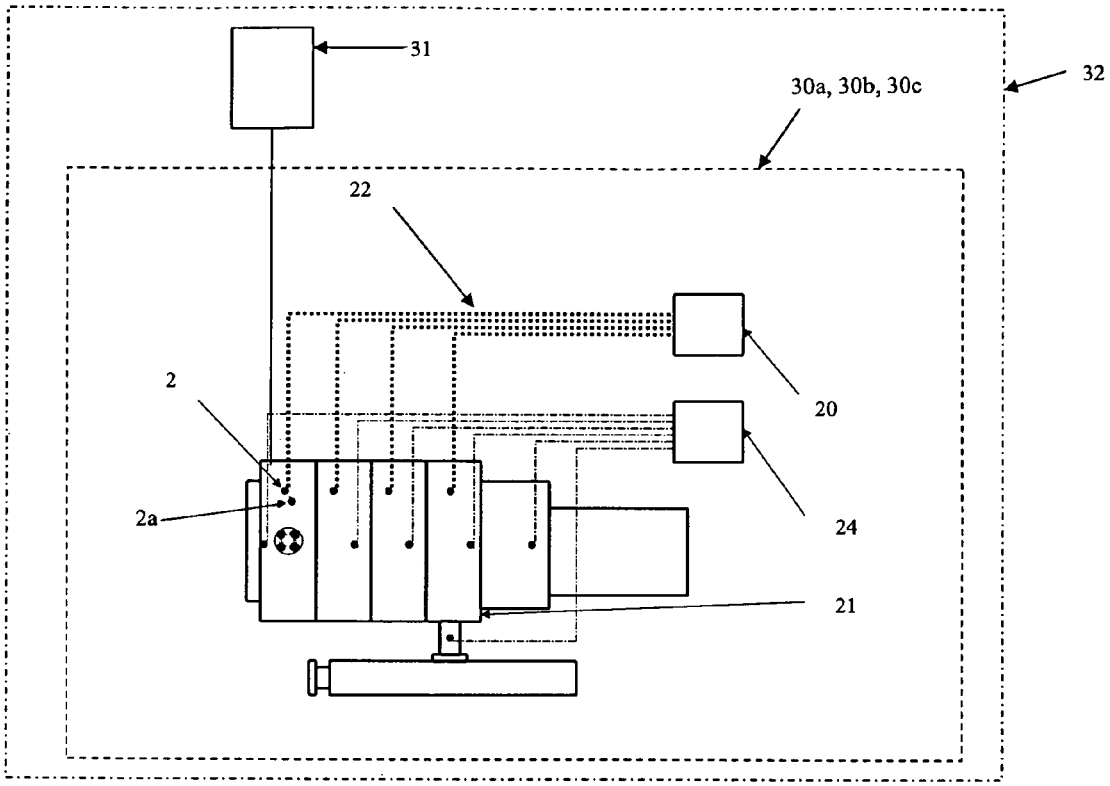
FIG. 5 illustrates an arrangement for supplying fluid to a pump
Figure 6:
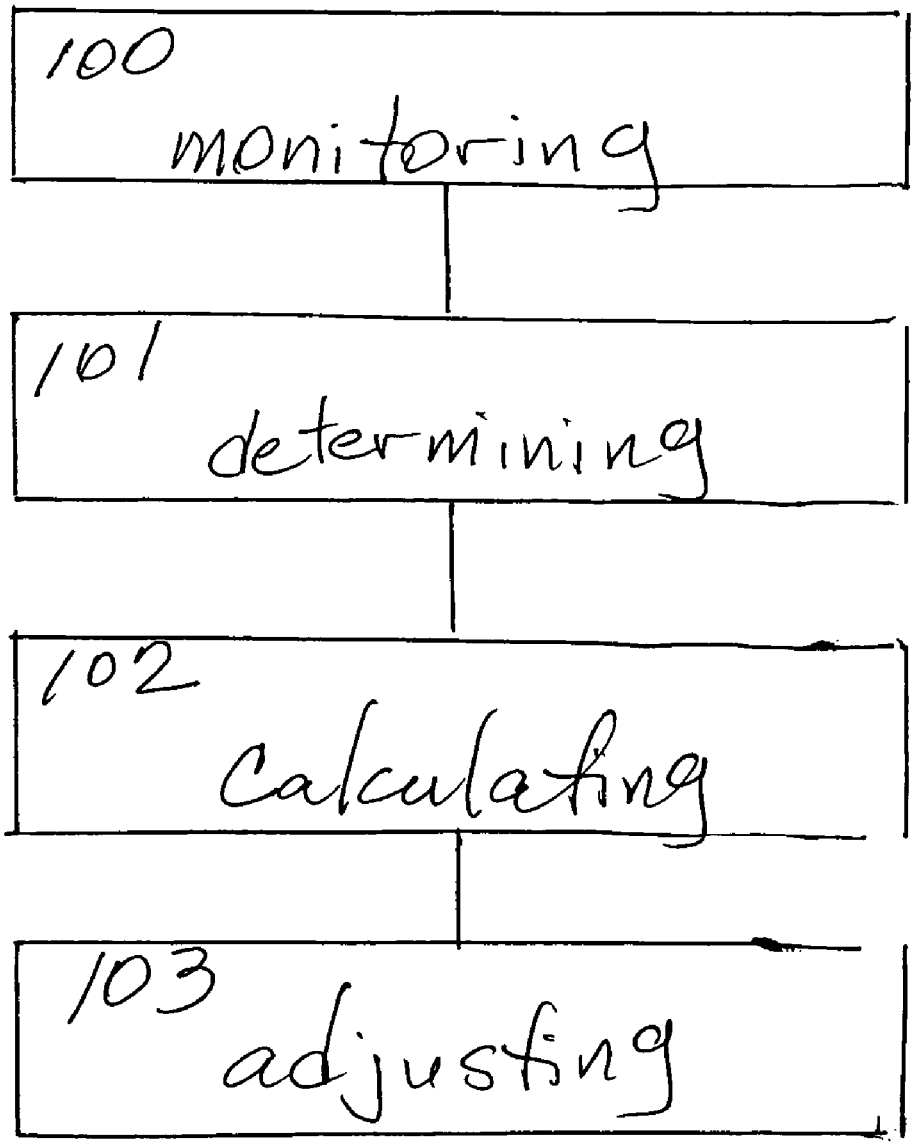
FIGS. 6-9 illustrate flowcharts in accordance with embodiments of the present invention.
Figure 7:
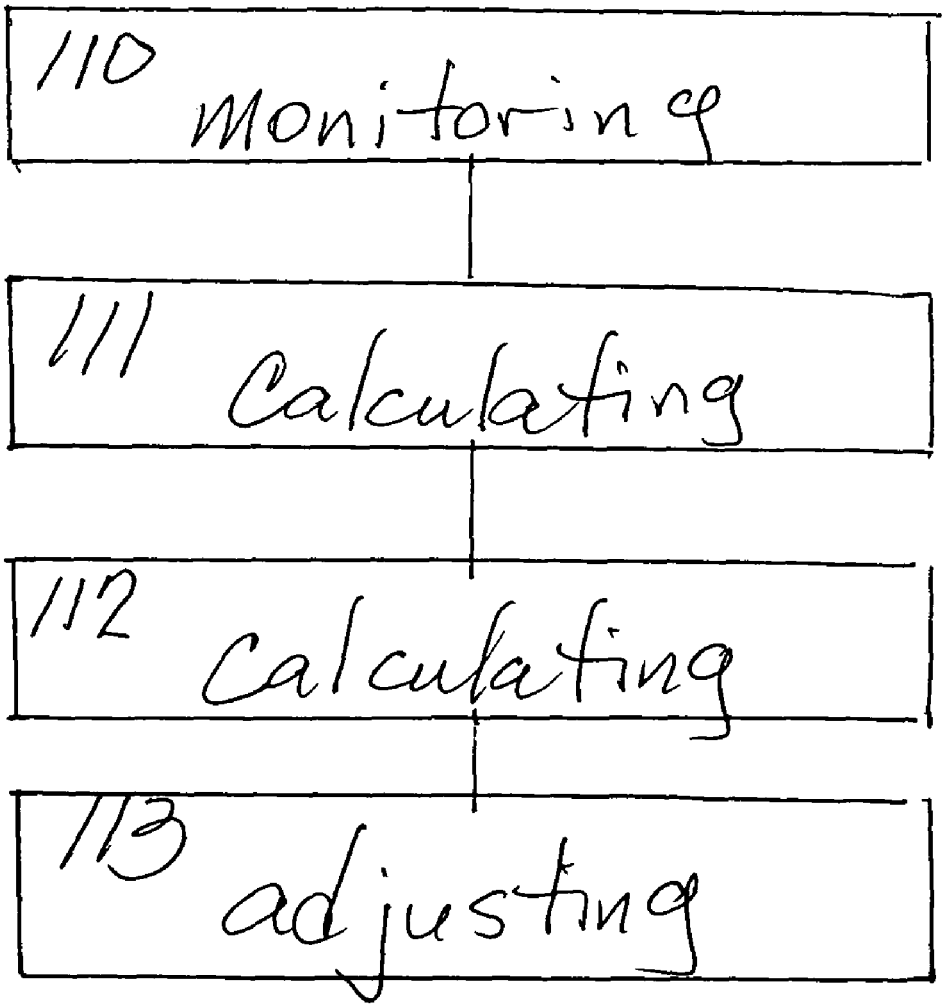
Figure 8:
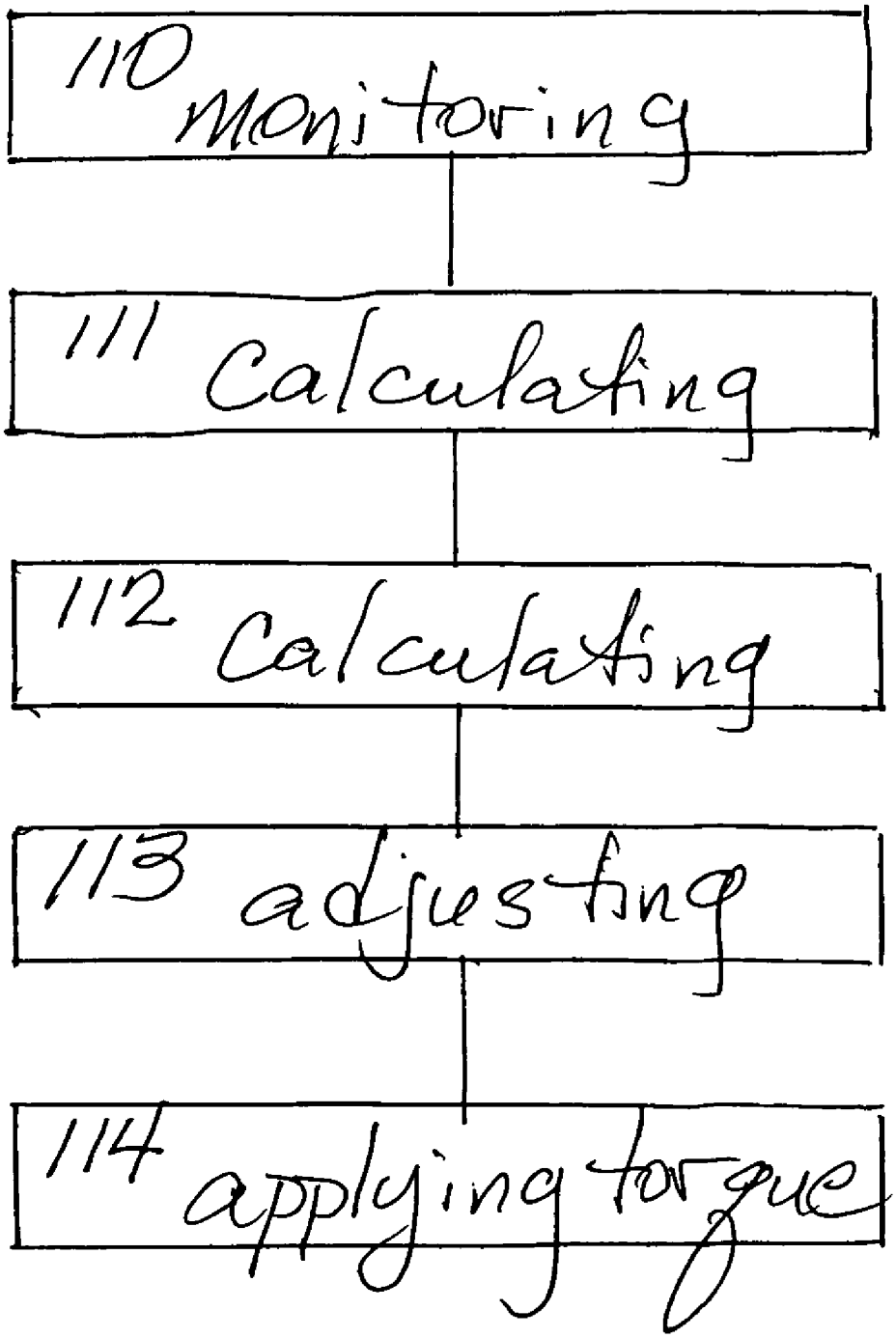
Figure 9:
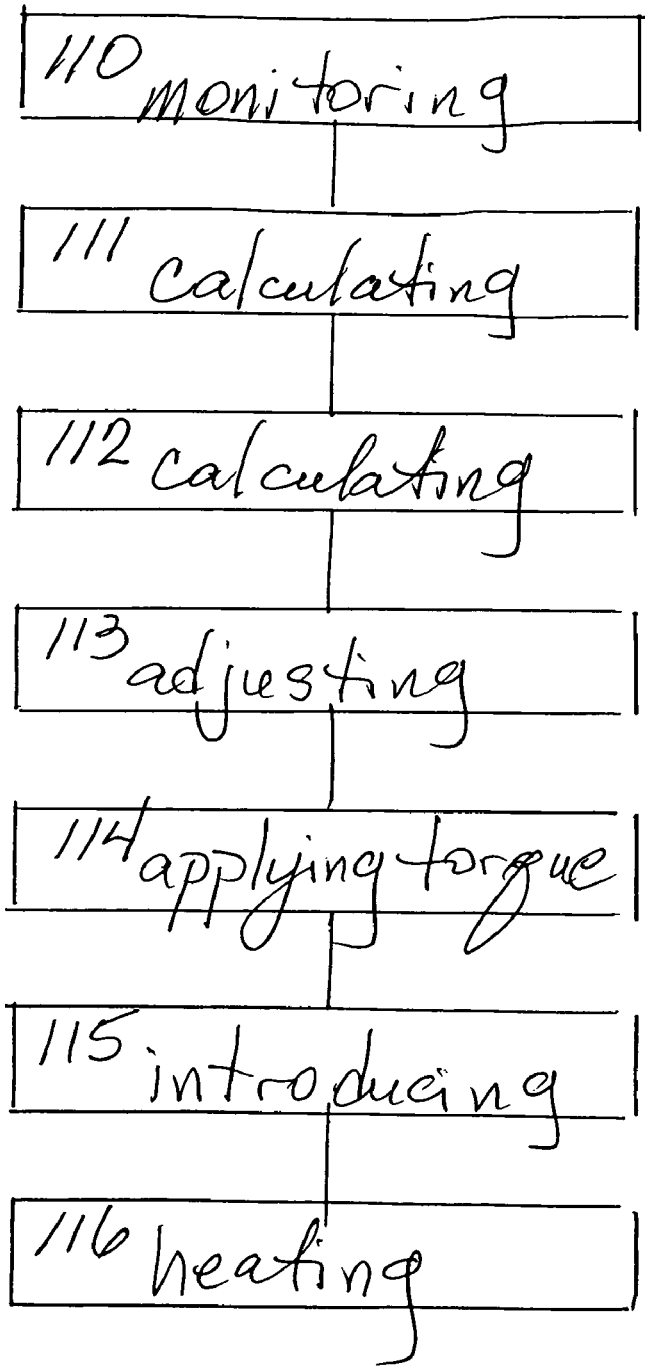
Figure 10:
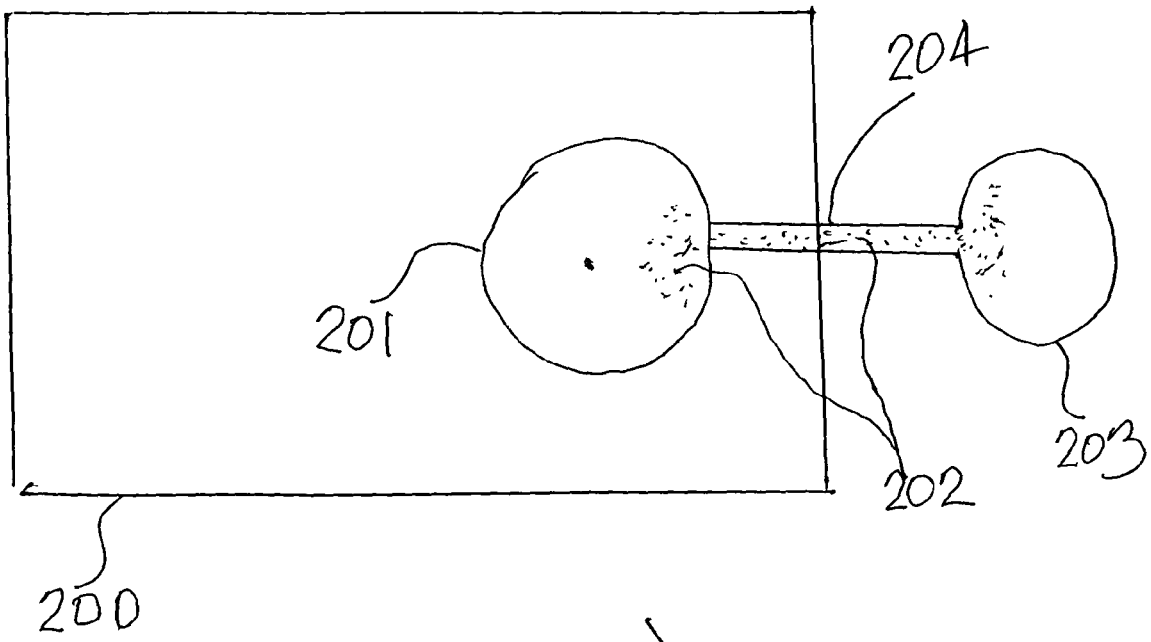
FIG. 10 illustrates a schematic view of a conventional chemical vapor deposition system.

Delivery of fluid may be performed through simple ports as liquid is drip-fed through a hole in the housing or nozzles 2*a* may be provided through which the fluid may be sprayed. Control systems may be introduced such that the solvent delivery can be performed in reaction to the changing conditions being experienced within the confines of the pump apparatus. For example, in the arrangement shown in FIG. 5, a control system 20 supplies cleaning fluid, for example, stage by stage, to the ports 2 of pump 21 via supply conduits 22. As indicated at 24, a purge gas system may also be provided for supplying a purge gas, such as nitrogen to the pump 21.

Where the process material is waxy or fatty, compatible solvents will need to be introduced to perform the dilution/cleaning function. Such solvents may be provided in liquid or vapour form. Any compatible, effective cleaning medium may be used such as xylene in the case of hydrocarbon based/soluble products or water in the case of aqueous based/soluble products, alternatively, detergents may be used.

Where the process material is a by-product of a CVD process, the cleaning fluid may comprise a fluorinated gas. Examples of such cleaning fluid include, but are not restricted to, $ClF_3$, $F_2$, and $NF_3$. The high reactivity of fluorine means that such gases would react with the solid by-products on the pump mechanism, in order to allow the by-products to be subsequently flushed from the pump with the exhausted gases. To avoid corrosion of internal components of the pump by the fluorinated gases, materials need to be carefully selected for use in forming components of the pump, such as the rotor and stator elements, and any elastomeric seals, which would come into contact with the cleaning gas.

The outer housing/stator 5 as illustrated in FIG. 3 is provided as a two-layer skin construction, an inner layer 6*a* and an outer layer 9. It is the inner layer 6*a* that acts to define the stator cavity 6 of the pump. A cavity 7 is provided between the layers 6*a* and 9 of the outer housing/stator 5 such that a cooling fluid, such as water, can be circulated around the stator in order to conduct heat away from the working section of the pump. This cavity 7 is provided over the entire length of the rotor i.e. over the inlet region 3 as well as the exhaust region 4. Under circumstances where the pump has become seized due to cooling of the rotor which, in turn, solidifies residues on the surfaces between the rotor and the stator, the 'cooling liquid' in the cavity 7 of the outer housing/stator 5 may be heated to raise the temperature of the rotor 1. This can enhance the pliability of the residue and may assist in releasing the mechanism. The outer housing/stator 5 is provided with pillars 8 of solid material through the cavity 7 in order to provide regions where injection ports 2 can be formed.

The present invention is not restricted for use in screw pumps and may readily be applied to other types of pump such as Northey ("claw") pumps or Roots pumps.

In summary, a pump comprises at least one rotor 1, a stator/outer housing 5, the rotor 1 being enclosed by the outer housing/stator 5. The outer housing/stator 5 comprises at least one port 2 extending through the outer housing/stator 5 to enable delivery of a fluid directly onto a surface of the at least one rotor 1.

It is to be understood that the foregoing represents just a few embodiments of the invention, others of which will no doubt occur to the skilled addressee without departing from the true scope of the invention as defined by the claims appended hereto.

We claim:

1. A pump comprising:

a rotor and a stator;

a housing enclosing the rotor and the stator, the housing having an inlet for receiving a first fluid, and a port positioned downstream and spaced apart from the inlet; and means for injecting a second fluid into the housing through the port in a first direction not in direct opposite to a second direction in which the first fluid flows into the housing via the inlet, wherein the second fluid acts on deposits on a surface of the rotor and a surface of the stator, and wherein the second fluid comprises a reactive substance for reacting with deposits on the surface of the rotor and the surface of the stator.

2. The pump according to claim 1 comprising a plurality of ports.

3. The pump according to claim 2 wherein the ports are located radially about the housing.

4. The pump according to claim 2 wherein the ports are located along a length of the rotor.

5. The pump according to claim 4 wherein at least one of the ports includes a nozzle for spraying the second fluid.

6. The pump according to claim 5 wherein the nozzle is integrally formed within at least one of the ports.

7. The pump according to claim 2 wherein at least one of the ports includes a nozzle for spraying fluid.

8. The pump according to claim 7 wherein the nozzle is integrally formed within at least one of the ports.

9. The pump according to claim 8 wherein the housing comprises a two skinned wall having an inner skin and an outer skin and forming a cavity between the inner and outer skins.

10. The pump according to claim 9 wherein the inner skin of the housing is adapted to form the stator.

11. The pump according to claim 7 wherein the second fluid is a liquid.

12. The pump according to claim 11 wherein the second fluid is a solvent.

13. The pump according to claim 7 wherein the second fluid is a gas.

14. The pump according to claim 13 wherein the second fluid is steam.

15. The pump according to claim 7 wherein the second fluid comprises a reactive substance for reacting with the deposits.

16. The pump according to claim 15 wherein the second fluid comprises a halogen.

17. The pump according to any of claim 15 wherein the second fluid comprises a compound selected from the group consisting of $ClF_3$, $F_2$, and $NF_3$.

18. The pump according to claim 1 wherein the pump is a screw pump having two threaded rotors.

19. The screw pump according to claim 18 wherein the port is located downstream of a first two complete turns of thread of the threaded rotors.

20. The pump according to claim 1 wherein the pump is a claw pump.

21. The pump according to claim 1 wherein the pump is a Roots pump.

22. The pump according to claim 1 wherein the second fluid is a liquid.

23. The pump according to claim 1 wherein the second fluid is a solvent.

24. The pump according to claim 1 wherein the second fluid is a gas.

25. The pump according to claim 24 wherein the second fluid is steam.

26. The pump according to claim 1 wherein the housing comprises a two skinned wall having an inner skin and an outer skin and forming a cavity between the inner and outer skins.

27. The pump according to claim 26 wherein the inner skin of the housing is adapted to form the stator.

28. The pump according to claim 1 wherein the pump is connected to a chemical vapor deposition apparatus having a process chamber and an outlet of the process chamber, wherein the pump inlet is connected to the outlet of the process chamber, and wherein the deposits are a by-product of a chemical vapor deposition process.

29. A pump comprising:

a rotor and a stator;

a housing enclosing the rotor and the stator and having an inlet for receiving a first fluid, and a port positioned downstream and spaced apart from the inlet; and means for injecting a fluid into the housing through the port in a first direction not in direct opposite to a second direction in which the first fluid flows into the housing via the inlet, wherein the fluid comprises a reactive substance for reacting with particulates on a surface of the rotor and a surface of the stator.

30. The pump according to claim 29 wherein the fluid comprises a halogen.

31. The pump according to claim 29 wherein the fluid comprises a compound selected from the group consisting of $ClF_3$, $F_2$, and $NF_3$.

32. A method of managing deposits within a pump, the pump comprising a rotor and a stator, and a housing enclosing the rotor and the stator, the housing having an inlet for receiving a first fluid, and downstream, spaced apart from the inlet, a port, the method comprising:

injecting into the housing via the port a second fluid for acting on deposits on a surface of the rotor and a surface of the stator, wherein the second fluid is injected into the housing in a first direction not in direct opposite to a second direction in which the first fluid flows into the housing via the inlet, and wherein the second fluid comprises a reactive substance for reacting with the deposits on the surface of the rotor and the surface of the stator.

33. The method according to claim 32 wherein the second fluid is injected from a plurality of ports.

34. The method according to claim 33 wherein the ports are located radially about the housing.

35. The method according to claim 33 wherein the ports are located along a length of the rotor.

36. The method according to claim 33 wherein the second fluid is injected through the ports at predetermined intervals.

37. The method according to claim 32 wherein the second fluid is a liquid.

38. The method according to claim 32 wherein the second fluid is a solvent.

39. The method according to claim 32 wherein the second fluid is a gas.

40. The method according to claim 39 wherein the second fluid is steam.

41. The method according to claim 32 wherein the second fluid comprises a reactive substance for reacting with the deposits.

42. The method according to claim 32 wherein the second fluid comprises a halogen.

43. The method according to claim 32 wherein the second fluid comprises a compound selected from the group consisting of $ClF_3$, $F_2$, and $NF_3$.

44. The method according to claim 32 wherein the second fluid is injected through the port at predetermined time intervals.

45. The method according to claim 32 further comprising the steps of:

(a) monitoring the performance of the pump;

(b) determining accumulation of the deposits on the internal surfaces based on the monitored performance;

(c) calculating a rate of flow of the second fluid required to compensate for the accumulation of the deposits; and (d) adjusting the rate of flow of the second fluid to reflect the calculated rate of flow of the second fluid.

46. A method for managing deposits within a pump mechanism by delivering to a rotor of the pump, a fluid for dissolving, diluting or otherwise disengaging deposits which have accumulated on the internal working surfaces of the pump, the method comprising the steps of:

(a) monitoring the performance of the pump;

(b) calculating the rate of accumulation of the deposits on the internal working surfaces of the pump based on the monitored performance;

(c) calculating a rate of flow of the fluid, required to compensate for the accumulation of the deposits;

(d) adjusting the rate of flow of the fluid being delivered to the rotor to reflect the calculated rate of flow of the fluid;

wherein the pump is inoperative as the fluid is delivered, the method further comprising the step of applying torque to rotors of the pump to overcome any remaining impeding force.

47. A method for managing deposits within a pump mechanism by delivering to a rotor of the pump, a fluid for dissolving, diluting or otherwise disengaging deposits which have accumulated on the internal working surfaces of the pump, the method comprising the steps of:

(a) monitoring the performance of the pump;

(b) calculating the rate of accumulation of the deposits on the internal working surfaces of the pump based on the monitored performance;

(c) calculating a rate of flow of the fluid, required to compensate for the accumulation of the deposits;

(d) adjusting the rate of flow of the fluid being delivered to the rotor to reflect the calculated rate of flow of the fluid; wherein the pump is inoperative as the fluid is delivered;

the method further comprising the steps:

applying torque to rotors of the pump to overcome any remaining impeding force;

introducing a thermal fluid into a cavity formed within a housing of the pump, the cavity encircling the rotors; and heating the thermal fluid in the cavity to raise the temperature of the fluid and the deposits to release the deposits prior to the step of applying torque to the rotors.

* * * * *